US007503726B2

(12) United States Patent
Blackwood

(10) Patent No.: US 7,503,726 B2
(45) **Date of Patent: *Mar. 17, 2009**

(54) SUBSURFACE DRAINAGE SYSTEM AND DRAIN STRUCTURE THEREFOR

(75) Inventor: Charles R. Blackwood, Oklahoma City, OK (US)

(73) Assignee: Airfield Systems, LLC, Edmond, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/935,877

(22) Filed: Nov. 6, 2007

(65) Prior Publication Data

US 2008/0056824 A1 Mar. 6, 2008

Related U.S. Application Data

(63) Continuation of application No. 11/216,845, filed on Aug. 31, 2005, now Pat. No. 7,290,958.

(60) Provisional application No. 60/632,904, filed on Dec. 3, 2004.

(51) Int. Cl.
*E02B 11/00* (2006.01)

(52) U.S. Cl. ..... 405/50; 405/43; 405/45; 52/169.5

(58) Field of Classification Search ..... 405/50, 405/36, 43–37; 52/169.5, 180, 181; 404/36
See application file for complete search history.

(56) References Cited

U.S. PATENT DOCUMENTS

| | | | | | |
|---|---|---|---|---|---|
| 1,765,652 | A * | 6/1930 | Burgess | ..... | 52/181 |
| 5,250,340 | A * | 10/1993 | Bohnhoff | ..... | 52/180 |
| 5,848,856 | A * | 12/1998 | Bohnhoff | ..... | 405/36 |
| 6,428,870 | B1 * | 8/2002 | Bohnhoff | ..... | 52/180 |
| 6,450,731 | B1 * | 9/2002 | Bohnhoff | ..... | 405/36 |
| 7,108,454 | B2 * | 9/2006 | Blackwood | ..... | 405/36 |
| 7,290,958 | B2 * | 11/2007 | Blackwood | ..... | 405/50 |

* cited by examiner

*Primary Examiner*—Frederick L Lagman
(74) *Attorney, Agent, or Firm*—Dunlap Codding, P.C.

(57) ABSTRACT

A subsurface drainage assembly for directing fluid drainage from a surface is disclosed. The subsurface drainage assembly includes a plurality of drain structure panels linked together in a manner that permits movement of one drain structure panel relative to the adjacent drain structure panel. The drain structure panels have a laterally extensive backing grid and a plurality of spaced apart tubular support members projecting therefrom. The tubular support members have at least one fluid flow opening formed through a sidewall so as to intersect a second end of the tubular support members at two rounded corners. The tubular support members are tapered so that the tubular support members are nestable with the tubular support members of an identical drain structure panel when the drain structure panels are stacked.

10 Claims, 6 Drawing Sheets

SUBSURFACE DRAINAGE SYSTEM AND DRAIN STRUCTURE THEREFOR

CROSS REFERENCE TO RELATED APPLICATIONS

This application is a continuation of U.S. Ser. No. 11/216,845, filed Aug. 31, 2005, now U.S. Pat. No. 7,290,958 which claims benefit of U.S. Provisional Application No. 60/632,904, filed Dec. 3, 2004, which is incorporated herein by reference in its entirety.

BACKGROUND OF THE INVENTION

1. Field of the Invention

The present invention generally relates to systems for subsurface fluid drainage, and more particularly, but not by way of limitation, to a subsurface drainage system and a drain structure therefor which promotes rapid infiltration of water through a subsoil structure.

2. Brief Description of Related Art

It is known that adequate drainage is a key to maintaining quality turf on athletic playing fields, such as football and soccer fields, baseball diamonds, golf courses, and the like. Further, well drained playing fields eliminate or significantly decrease the time during which heavy precipitation would make the field unuseable.

Previous efforts have been made in the field of subsurface drainage systems for sports fields and the like. In particular, U.S. Pat. No. 5,848,856 has been issued to William Bohnhoff. The Bohnhoff '856 patent discloses a subsurface drainage system that includes a base layer having a sloped surface and covered with an impermeable liner, a drainage collection pipe at the bottom of each sloped surface, an intermediate layer formed by a drain structure overlying the impermeable liner, a filter fabric layer, a root zone layer, and a turf. The drain structure is a thermoplastic mat with a laterally extensive backing grid having a plurality of intersecting struts defining grid openings therebetween and a plurality of spaced cylindrical support members projecting from the backing grid whereby fluid may flow through the backing grid and the cylindrical support member.

Similar drain structures have also been used in the construction of a variety of surfaces, such as grass covered driveways, roads and parking lots, as well as gravel covered parking lots, driveways, and trails. The drain structure functions to stabilize particulate materials, including soil, sand, gravel, and asphalt, and thereby reduce erosion while also supporting the weight of vehicular and pedestrian traffic to prevent the creation of ruts in the surface.

While use of the drainage structure, like that described above, have met with success, the transportation of such drain structures can be expensive, and its installation tedious and time consuming. The present invention is directed to a subsurface drainage system and drain structure therefor that overcome the problems of the prior art.

BRIEF DESCRIPTION OF THE SEVERAL VIEW OF THE DRAWINGS

DETAILED DESCRIPTION OF THE INVENTION

Figure 1:
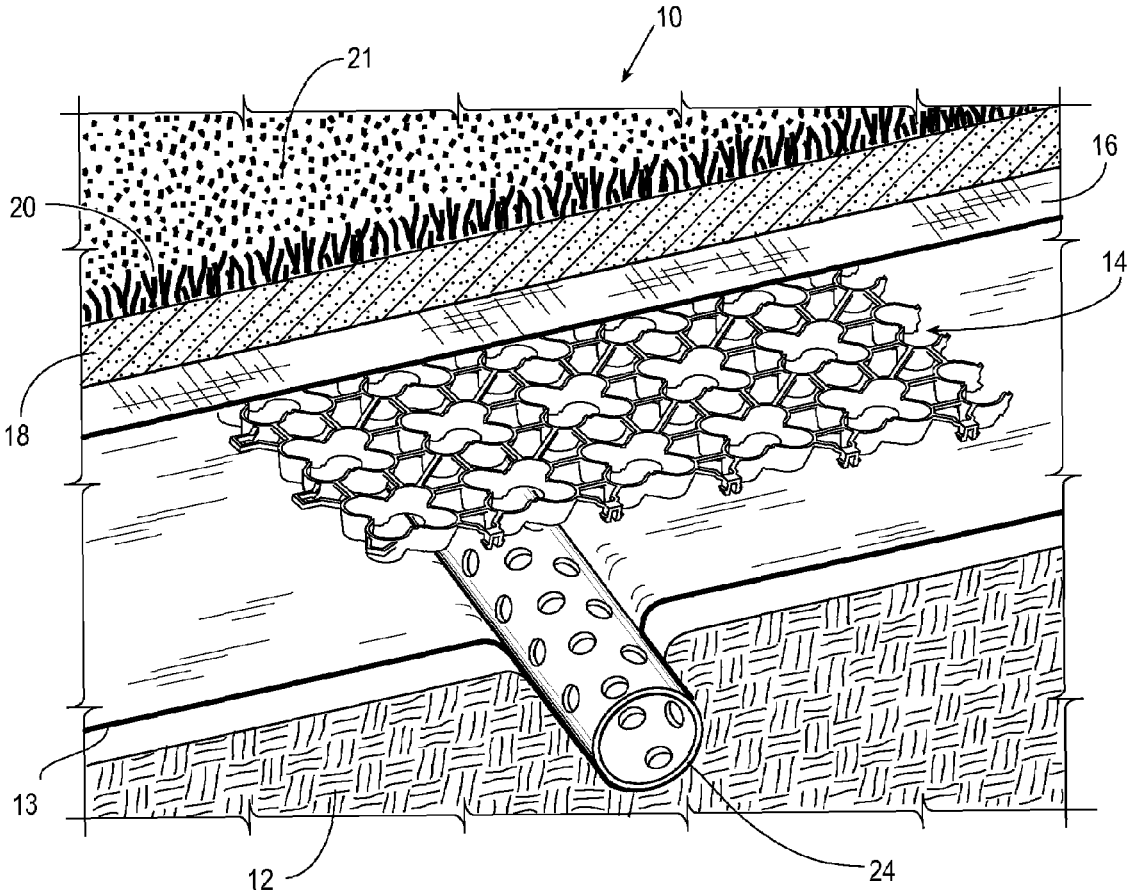
FIG. 1 is a sectional view of a subsurface drainage system constructed in accordance with the present invention.

Referring now to the drawings, and more particularly to FIG. 1, shown is a subsurface drainage system 10 constructed in accordance with the present invention. The subsurface drainage system 10 includes a base layer 12, an impermeable liner 13, a drain structure 14, a semi-permeable filter fabric layer 16, a root zone layer 18, and a turf layer 20 defining a playing surface 21. In instances where it is desirable to allow some permanent deep infiltration of surface drainage, the impermeable liner 13 may be replaced with a semi-permeable geotextile fabric or the drain structure 14 placed directly on the base layer 12.

The subbase 12 typically includes a subsoil that has been graded and packed to predetermined slope to direct by gravity the movement of subsurface water. The subbase 12 is sloped preferably from about one degree to about fifteen degrees to induce downhill water flow. A perforated collector pipe 24 preferably is installed at the down slope terminus of each sloped portion of the subbase 12. The subbase 12 may be graded to define a broad V-shaped basin with the collector pipe 24 at the bottom thereof so that water drains down opposing sides of the basin toward a common collection point at the bottom of the basin. The invention is not limited to such a configuration, however, and any of a wide variety of sloped subbase arrangements may be used. The area of the subbase 12 will generally correspond to the area of the playing surface 21.

Liquid infiltrating the turf layer 20 percolates downward by the force of gravity through the root zone layer 18 and the filter fabric layer 16 and then encounters the drain structure 14. The liquid flows freely downhill through and along the drain structure 14 until reaching a collection point at the bottom of the sloped surfaces of the subbase 12, where it enters the perforated collector pipe 24 beneath the drain structure 14 and below the grade of the subbase 12. The collector pipe 24 is pitched to provide drainage there along so that the collected liquid may be discharged or collected in a container (not shown) for treatment, off-site disposal, or re-use.

As will be described in greater detail below, the drain structure 14 will generally have an areal size that corresponds to the areal size of the playing surface 21 and provides a permanent layer of subsurface air space or void through which large volumes of fluid may rapidly move. The impermeable liner 13 is positioned between the drain structure 14 and the subbase 12. The filter fabric layer 16 is disposed flush upon the top surface of the drain structure 14 and acts to prevent migration of medium that makes up the root zone layer 18 into the drain structure 14. The root zone layer 18 is deposited to a suitable depth. The entire surface at the top of the root zone layer 18 may then be graded as desired to provide the desired playing surface 21 and the turf layer 20 laid on the root zone layer 18.

It will be appreciated that while the turf layer 20 in FIG. 1 represents natural turf, the turf layer 20 may also be artificial turf. In which case, the root zone layer 18 would typically be eliminated and the artificial turf layer placed directly on the filter fabric layer 16.

Depending upon the size and shape of the surface to be drained, and upon the graded configuration and number of sloped surfaces of the subbase 12, a plurality of collector pipes 24 may be networked according to known hydraulic principles to channel and direct into a trunk collector pipe the liquids gathered and drained from the drain structure 14.

Figure 2:
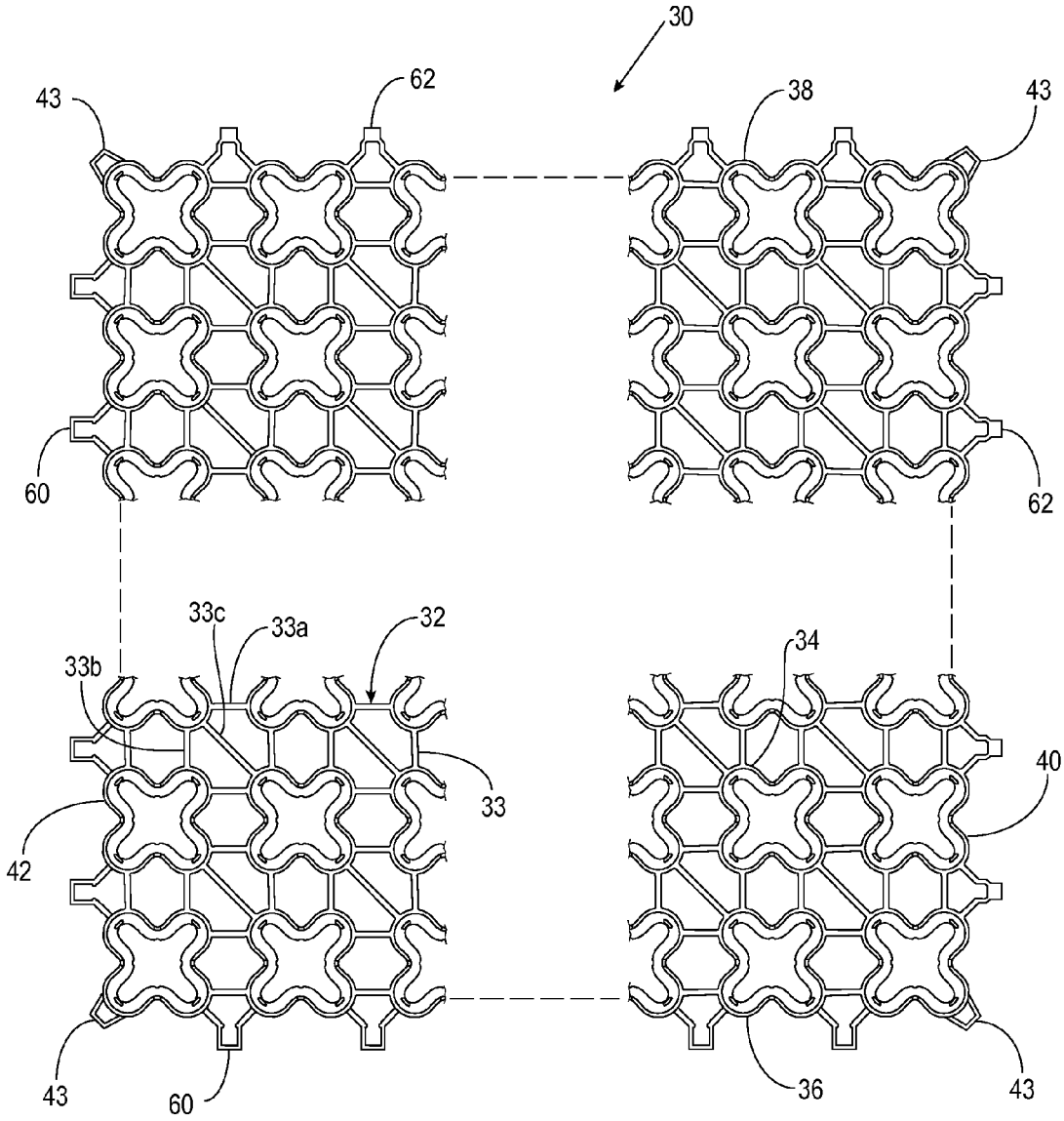
FIG. 2 is a top plan view of a drain structure panel constructed in accordance with the present invention.

Referring now to FIG. 2, a top plan view of a drain structure panel 30 is illustrated. The drain structure panel 30 is utilized in the construction of the drain structure 14 of FIG. 1. The drain structure 14 is assembled from a plurality of interlinked drain structure panels 30. While FIG. 1 shows a portion of a single drain structure panel 30, it is understood that in the ordinary practice of the invention a plurality of drain structure panels 30 are interconnected in two lateral dimensions, the plurality of panels 30 thus comprising the drain structure 14.

Each drain structure panel 30 preferably is composed of injection-molded plastic, such as high-density polyethylene or polypropylene. Drain structure panels 30 manufactured from low-density polyethylene are also applicable in situations where reduced cost or increased flexibility are desired. Certain elements of each drain structure panel 30 are designed and manufactured to have an inflexible rigidity that provides structural strength to the drain structure 14, yet other portions of each drain structure panel 30 are shaped to be flexible to permit easy rolling, transportation, manipulation, and placement of the drain structure panels 30 for installation and/or assembly. More specifically, each drain structure panel 30 includes a backing grid 32 made from a plurality of struts 33 and a plurality of spaced support members 34 projecting from the backing grid 32. Certain support members are labeled 34 in FIG. 2, but it is readily understood that a given panel includes a number of other identical support members. The backing grid 32 provides flexibility to the overall drain structure panel 30, while the support members 34 provide desired compression strength.

Figure 3:
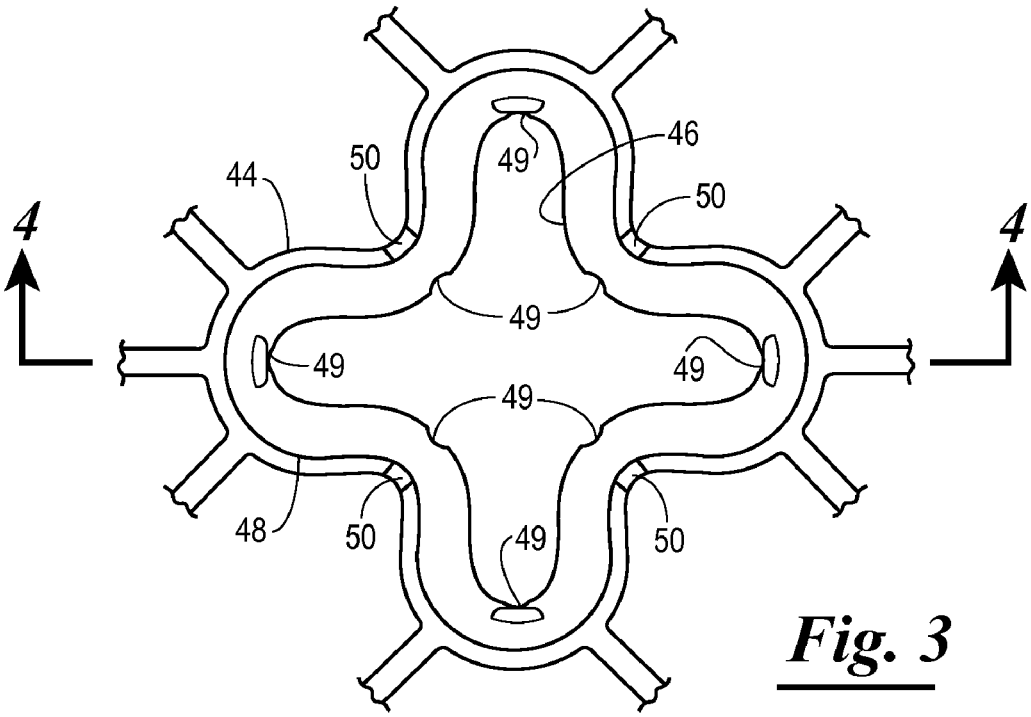
FIG. 3 is a top plan view of a tubular member of the drain structure of FIG. 2.
Figure 4A:
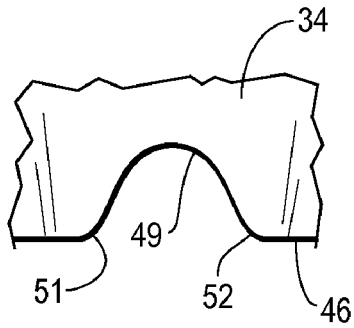
FIG. 4A is a side elevational view of a portion of the support member.
Figure 4:
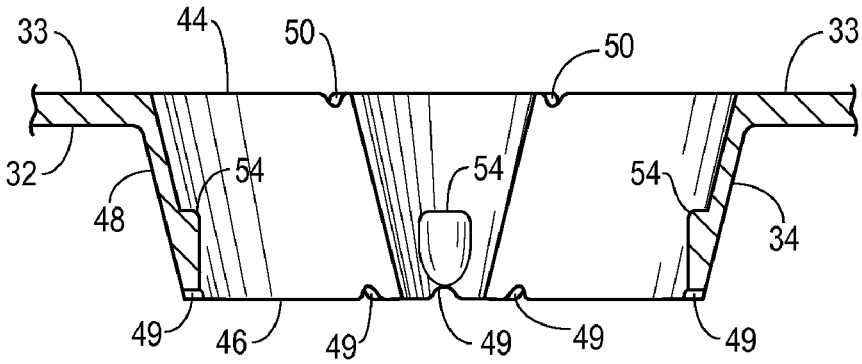
FIG. 4 is a cross-sectional view taken along line 4-4 of FIG. 3.
Figure 5:
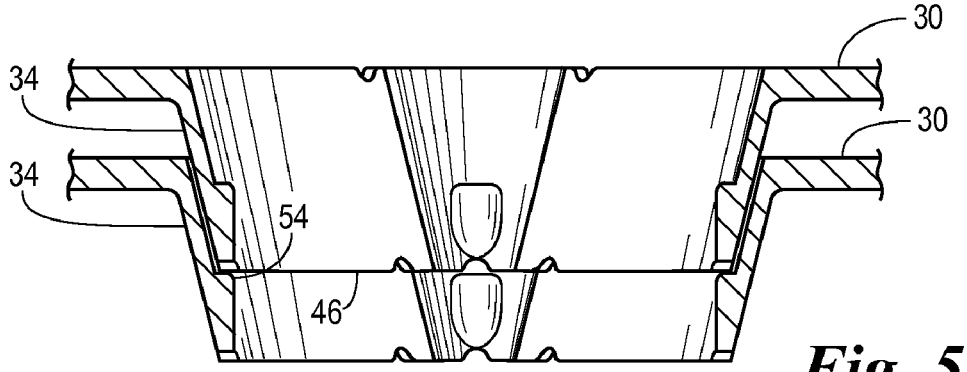
FIG. 5 is a sectional view of a pair of support members shown nested relative to one another.

The support members 34 lend integrity and strength to the drain structure panel 30. The backing grid 32 is moderately flexible in a direction perpendicular to the plane of the drain structure panel 30, interconnects the support members 34, and maintains the support members 34 in a spaced-apart relation to each other. As shown in FIG. 2, the support members 34 are uniformly arrayed horizontally in perpendicular rows and columns. As shown in FIGS. 2-4, the support members 34 are fashioned in the form of tapered, four-leaf clover shaped rings, but it will be appreciated that support members of other than clover shape may be used in the invention. Support members 34 having circular, hexagonal, square, rectangular, or other cross-sectional shapes may be utilized. However, the support members 34 preferably are generally tubular so that water, air, and other fluids may flow freely through the support members 34. Also, the support members 34 need not be arrayed in perpendicular rows and columns, because circular, random, or other arrays may function within the scope of the invention. The support members 34 are preferably of a uniform height, and thus serve to define the overall thickness of the drain structure panel 30, which may be, by way of example, approximately 1.0 inch.

The support members 34 are preferably molded integrally with the backing grid 32 so that the drain structure panel 30 is further characterized as having a first side 36, a second side 38, a third side 40, and a fourth side 42. For reasons to be discussed below, the drain structure panel 30 is formed so that the internal flow area of each of the support members 34 is void of struts 33. Otherwise, a series of horizontal struts 33*a*, vertical struts 33*b*, and diagonal struts 33*c* are shown extending between adjacent support members 34. In a preferred embodiment, the struts 33 extend from one support member 34 to another support member 34 without intersecting another strut 33, thereby reducing the amount of material used to form the backing grid 32 and increase flow area. However, the struts 33 may be formed in a variety of arrangements, including intersecting arrangements, to alter the strength and flexibility of the drain structure panel 30, as well as the size of the grid openings defined between the struts 33 and the support members 34.

Figure 2A:
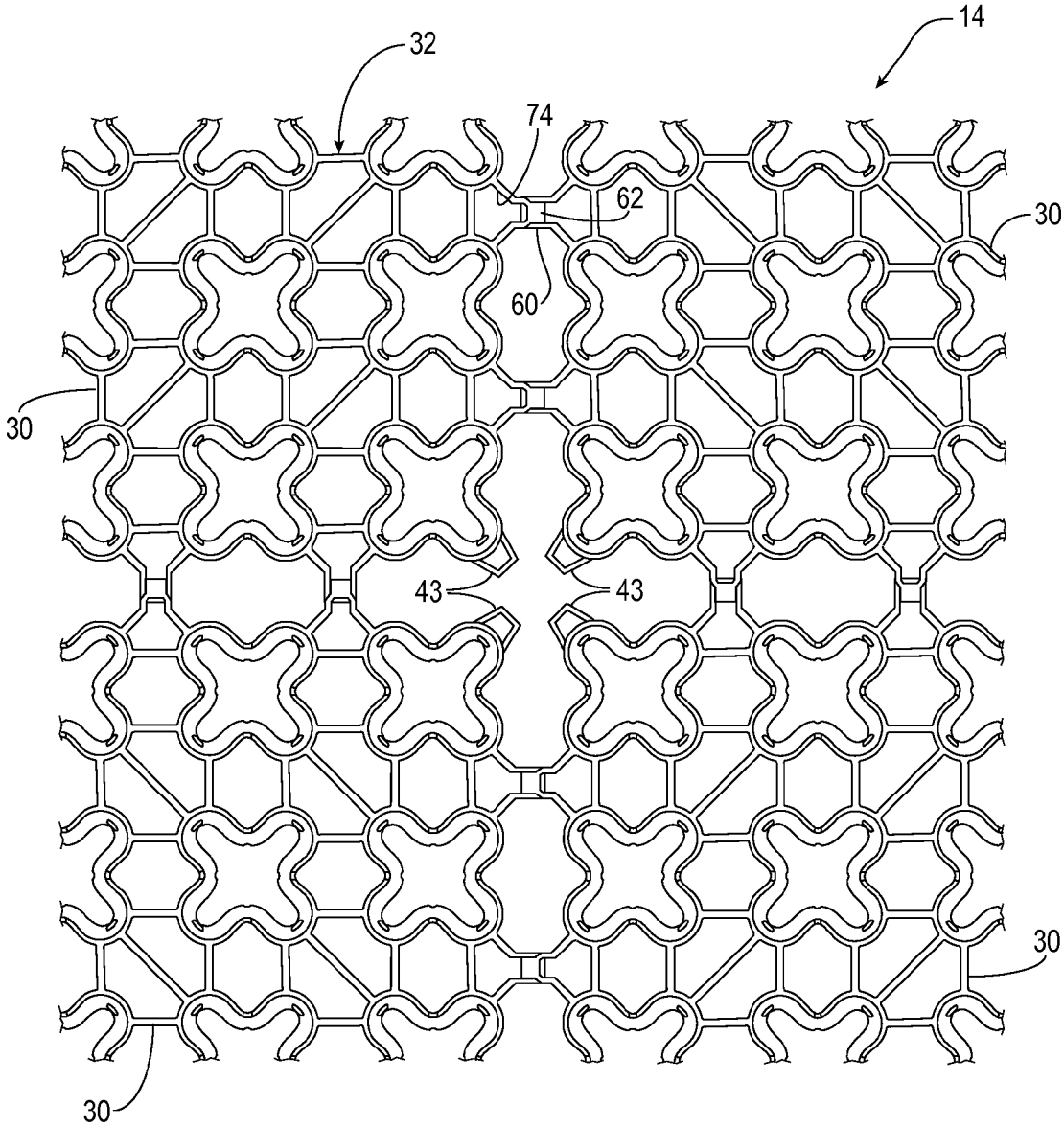
FIG. 2A is a top plan view of a portion of a plurality of drain structure panels shown linked together.

To provide a uniform platform for the filter fabric 16, the support members 34 at the corners of the drainage structure panel 30 are provided with a generally U-shaped extension member 43 that extends outwardly to fill void space between adjacent drainage structure panels 30. As shown in FIG. 2A, when the drain structure panels 30 are linked together, the extension members 43 cooperate to form a platform to support the filler fabric 16.

The drain structure panel 30 is generally flat with a constant thickness, and defines two substantially parallel planes, one plane containing the backing grid 32 and the other plane generally defined by the opposing ends of the support members 34. Advantageously, fluids may freely flow through the grid openings between struts 33. Also, the integration of the support members 34 with the backing grid 32 maintains adjacent support members 34 in a spaced-apart relation, leaving ample space through which fluids may flow.

Referring now to FIGS. 3 and 4, the support members 34 are characterized as having a first end or upper end 44 connected to the backing grid 32, a second end or lower end 46 opposite the first end 44, and a sidewall 48 extending therebetween. To facilitate fluid flow through the support members 34 when the second end 46 of the support members 34 are engaged with the impermeable line 13, each of the support members 34 is provided with a plurality of openings 49 (best shown in FIGS. 3 and 4) formed through the sidewall 48 on the second end 46 of the support members 34 and a plurality of openings 50 (best shown in FIGS. 3 and 4) formed through the sidewall 48 on the first end 44 of the support members 34. While four openings are shown formed in the first end 44 and eight openings are shown in the second end 46, it will be appreciated the number of openings, as well as the position of the openings, may be varied. For example, the support members 34 may be formed with only one opening in the first end 44 and the second end 46. In such case, the drain structure 14 would preferably be positioned on the subbase 12 with the opening positioned on the downhill side of the subbase 12 to promote the drainage of fluid therethrough.

The openings 49 are preferably rounded or arch shaped to eliminate stress risers and sized to permit fluid to flow freely therefrom when the second ends 46 of the support members 34 are engaged with the impermeable liner 13. Additionally, each of the openings 49 defines two corners 51 and 52 with the second end 46 of the support member 34. The corners 51 and 52 are rounded to a sufficient radius to provide a smooth, non-jagged transition from the second end 46 to the openings 49 which will prevent the impermeable liner 13 from being cut, torn, or punctured while the drain structure 14 is positioned on the impermeable liner 13 during the installation process, and in turn loaded with the weight of the root zone layer 18 and the turf layer 20, as illustrated in FIG. 1. In addition, the rounded corners 51 and 52 facilitate movement of the drain structure 30 over the impermeable liner 13 and relative to another drain structure panel 30 in a manner to be discussed below.

Likewise, the openings 50 are preferably rounded or arch shaped to eliminate stress risers and sized to permit fluid to flow freely therefrom when the first ends 44 of the support members 34 are engaged with the impermeable liner 13. Additionally, each of the openings 50 define two corners with the first end 44 of the support member 34. The corners are rounded in a manner described above in reference to the openings 49 to a sufficient radius to provide a smooth, non-jagged transition from the second end 44 to the openings 50 which will prevent the impermeable liner 13 from being cut, torn, or punctured when the first end 44 of the drain structure panels 34 are positioned on the impermeable liner 13 during the installation process, and in turn loaded with the weight of the root zone layer 18 and the turf layer 20. In addition, the rounded corners of the openings 50 facilitate movement of the drain structure 30 over the impermeable liner 13 and relative to another drain structure panel 30 in a manner to be discussed below.

Figure 6:
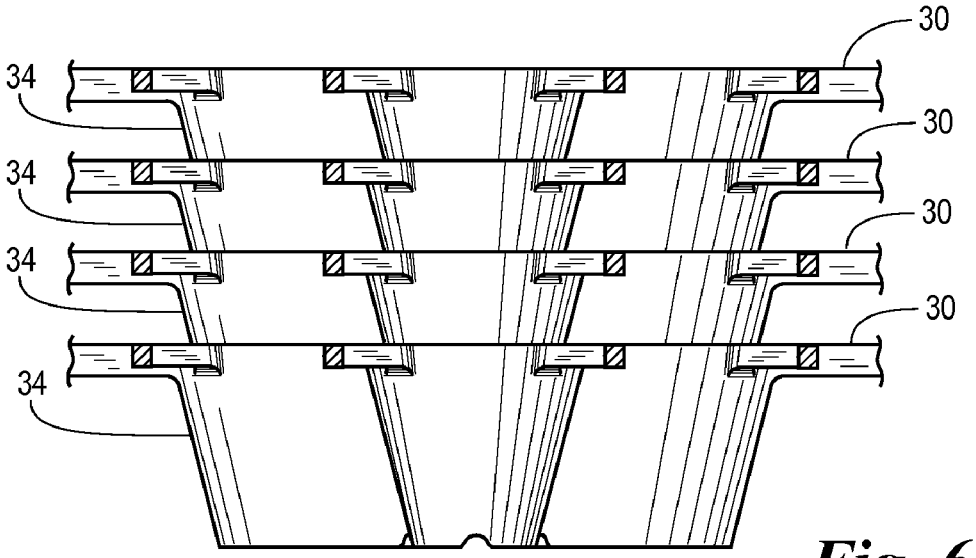
FIG. 6 is a side elevational view of a portion of a plurality of drain structures shown nested relative to one another.

As described above, the backing grid 32 is moderately flexible in a direction perpendicular to the plane of the drain structure panel 30. Such flexibility permits a row of interconnected drain structure panels 30 to be rolled on a spindle (not shown) for storage and transport. While storing and transporting the drain structure panels 30 in a rolled form permits quick and easy installation, shipping costs are increased due to the amount of space occupied by a row of rolled drain structure panels 30. To reduce space requirements, the support members 34 are tapered (FIG. 4) from the first end 44 to the second end 46 to permit the support members 34 of one drain structure panel 30 to be nested in the support members 34 of another drain structure panel 30 and in turn form a stack of drain structure panels, as shown in FIG. 6.

To facilitate removal of one drain structure panel 34 from an adjacent drain structure panel 34 during the installation process, the support members 34 are formed to have a plurality of stop members 54 formed as a step on the interior surface of the support members 34. The stop members 54 are positioned to engage the second end 46 of the nested support member 34 to prevent the nested support member 34 from becoming wedged in the adjacent support member 34. The support member 34 is shown to have four stop members 54, but it will be appreciated that any number of stop members may be formed so long the support members 34 are prevented from wedging too tightly with the adjacent support member 34.

Figure 7:
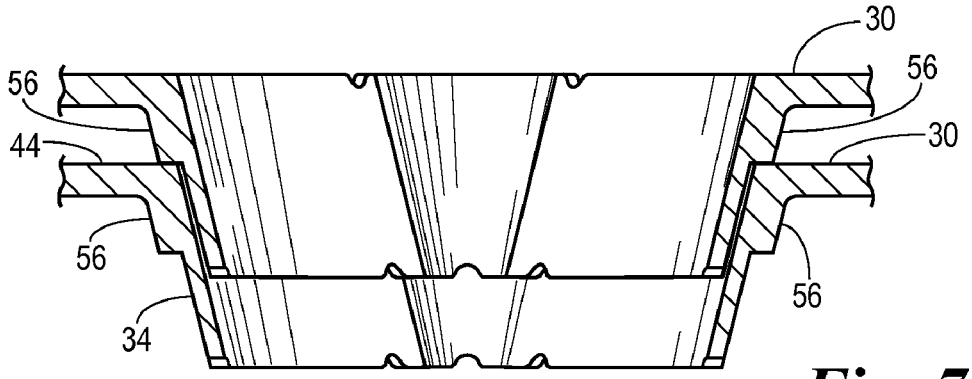
FIG. 7 is a sectional view of another embodiment of support members shown nested relative to one another.

FIG. 7 shows another embodiment of a support member 34 having stop member 56 formed as a shoulder on the exterior surface of the support members 34. The stop members 56 are positioned to engage the first end 44 of the support member 34 in which the support member 34 is nested to prevent the nested support member 34 from becoming wedged in the adjacent support member 34. The support member 34 is shown to have two stop members 56, but it will be appreciated that any number of stop members may be formed so long the support members 34 are prevented from wedging too tightly with the adjacent support member 34.

Figure 8:
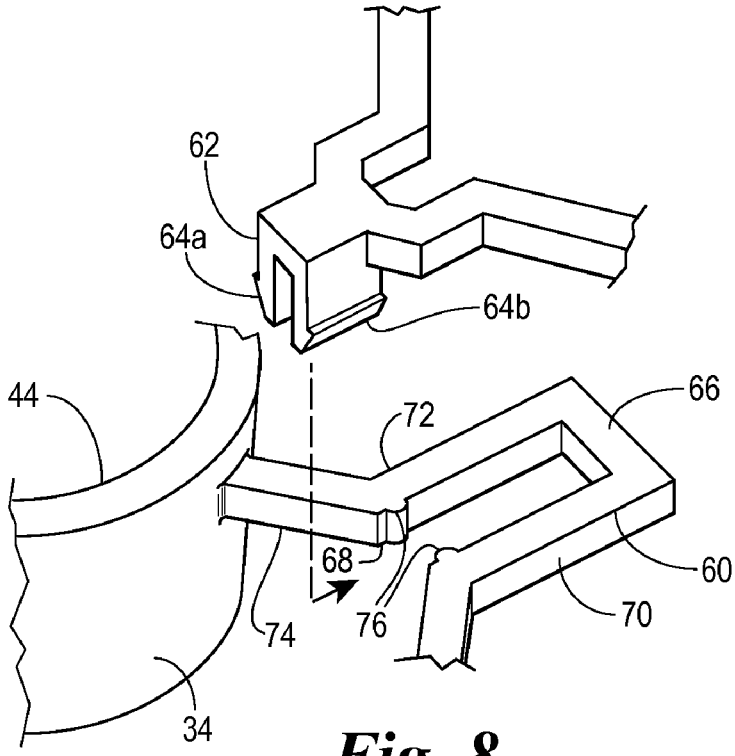
FIG. 8 is a perspective view of a portion of a pair of drain structure panels illustrating a male connector and a female connector.

Referring now to FIGS. 2, 2A, and 8, a plurality of drain structure panels 30 are secured together to form the drain structure 14 of a desired size. To permit attachment between adjacent drain structure panels 30, complimentary sets of male and female fasteners are formed on the side edges of each drain structure panel 30. In the illustrated embodiment, the female fasteners are fashioned in the form of sockets 60 formed along the first and fourth sides 36 and 42, respectively, and the male fasteners are fashioned in the form of pins 62 formed along the other second and third sides 38 and 40, respectively, so that the pins 62 are disposed opposite the sockets 60. Any two drain structure panels 30 may be secured in adjacent relation by inserting the pins 62 spaced along one side of one drain structure panel 30 through the sockets 60 spaced along the side of another substantially identical drain structure panel 30. The ends of the pins 62 may be formed with flexible flanged tabs 64*a* and 64*b* (best shown in FIG. 8) to secure the pins 62 in the sockets 60.

To facilitate the process of connecting one drain structure panel 30 to another drain structure panel 30, the sockets 60 of the female fasteners are defined by a first end 66, a second end 68 opposite the first end 66, a first side 70, and a second side 72 opposite the first side 70. The first end 66, the first side 70, and the second side 72 are closed to define the socket 60. The second end 68 is open to permit the pin 62 of the male fastener to be laterally inserted into the socket 60 from a grid opening 74. The first and second sides 70 and 72 are provided with retaining tabs 76 extending inwardly into the socket 60 near the second end 68 of the socket 60 to permit the pin 62 to be snapped into the socket 60 and in turn hold the pin 62 of the male fastener in the socket 60. The female fasteners are shown to be formed a distance below the upper end 44 of the tubular support member 34 while the male fasteners are shown to extend from the upper end 44. As such, the male fasteners will remain flush with the upper end 44 of the support members 34 and the struts 33 when the male fastener is connected to the female fasteners.

To connect one drain structure panel 30 to another drain structure panel 30, the pins 62 are positioned behind the sockets 60 in the adjacent grid opening 74 of the backing grid 32. The drain structure panels 30 are then moved laterally relative to one another so as to cause the pins 62 to snap into the sockets 62. Connecting the drain structure panels 30 in this manner permits the drain structures panels 30 to be assembled quickly and easily due to one drain structure panel 30 merely having to be laid on the adjacent drain structure panel 30 and moved laterally relative to one another without requiring each of the pins 62 to be aligned with and snapped into a corresponding socket 60.

During the process of installing the drain structure 14, the drain structure panels 30 are often exposed to radiant heat from the sun. The heat may in turn cause the drain structure panels 30 to expand. Such expansion will cause the drain structure 14 to buckle if adjacent drain structure panels 30 are not able to move relative to one another. In addition, when used with artificial turf, the artificial turf is generally placed on the drain structure 14 with only a filter fabric separating the artificial turf from the drain structure 14. It is well know that artificial turf tends to absorb heat energy which in turn is transferred to the drain structure 14. The heating of the drain structure 14 can again lead to buckling of the drain structure 14. However, in the case of artificial turf can also lead to buckling of the playing surface.

To permit movement of one drain structure panel 30 relative to an adjacent drain structure panel 30, the sockets 60 are shaped to permit compressional and extensional movement of one drain structure panel 30 relative to the adjacent drain structure panels 30 when the drain structure panels 30 are secured to one another. FIG. 8 shows the socket 60 having a rectangular configuration which allows the pins 62 to slide along the length of the sockets 60, even after the pins 62 have been snapped or locked into the sockets 60. By way of example, the pin 62 may have a thickness of approximately 0.25 inches while the socket 60 may have a length of approximately 0.3750 to 1.0000 inches. While the sockets 60 have been illustrated has having a rectangular configuration, it will be appreciated that the sockets may be formed to have other configurations which would result in a secure attachment while permitting relative movement.

Figure 9:
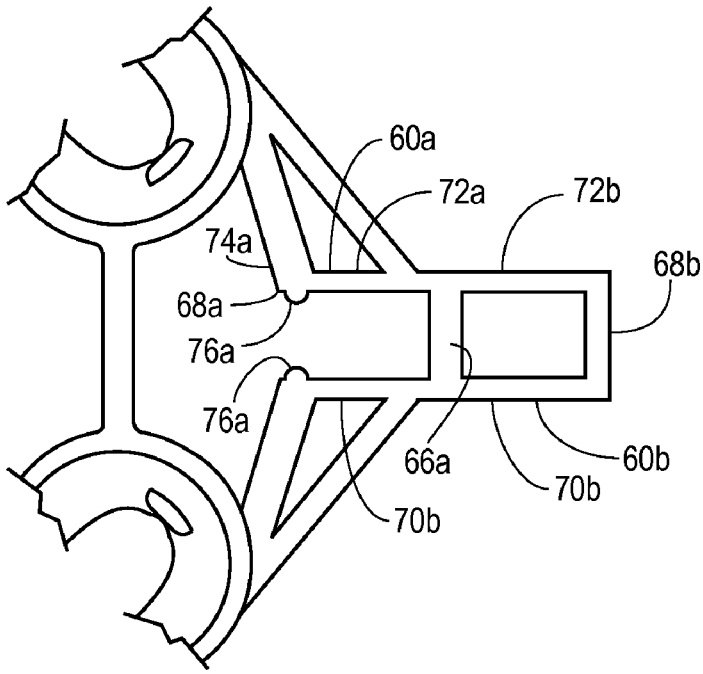
FIG. 9 is a top plan view of another embodiment of a female connector.

FIG. 9 illustrates another embodiment of a female fastener. The female fastener is fashioned in the form of two sockets 60*a* and 60*b*. Like the socket 60 described above, the sockets 60*a* of the female fastener is defined by a first end 66*a*, a second end 68*a* opposite the first end 66*a*, a first side 70*a*, and a second side 72*a* opposite the first side 70*a*. The first end 66*a*, the first side 70*a*, and the second side 72*a* are closed to define the socket 60*a*. The second end 68*a* is open to permit the pin 62 of the male fastener to be laterally inserted into the socket 60*a* from a grid opening 74*a*. The first and second sides 70*a* and 72*a* are provided with retaining tabs 76*a* extending inwardly into the socket 60*a* near the second end 68*a* of the socket 60*a* to permit the pin 62 to be snapped into the socket 60*a* and in turn hold the pin 62 of the male fastener in the socket 60*a*

The socket 60*b* extends from the socket 60*a* and is defined by the first end 66*a* of the socket 60*a*, a second end 68*b* opposite the first end 66*a*, a first side 70*b*, and a second side 72*b* opposite the first side 70*b*. The first end 66*a*, the second end 68*b*, the first side 70*b*, and the second side 72*b* are each closed to define the socket 60*b*.

To connect one drain structure panel 30 to another drain structure panel 30, the pins 62 may be positioned in either the socket 60*a* or 60*b*. When using the socket 60*a*, the pin 62 is positioned behind the sockets 60*a* in the adjacent grid opening 74*a* of the backing grid 32. The drain structure panels 30 are then moved laterally relative to one another so as to cause the pins 62 to snap into the sockets 62. Connecting the drain structure panels 30 in this manner permits the drain structures panels 30 to be assembled quickly and easily due to one drain structure panel 30 merely having to be laid on the adjacent drain structure panel 30 and moved laterally relative to one another without requiring each of the pins 62 to be aligned with and snapped into a corresponding socket 60*a*.

When using the socket 60*b*, the pin 62 is aligned with the socket 60*b* and pushed therein so that the pin snaps into the socket 60*b*.

To permit movement of one drain structure panel 30 relative to an adjacent drain structure panel 30, the sockets 60*a* and 60*b* are preferably shaped to permit compressional and extensional movement of one drain structure panel 30 relative to the adjacent drain structure panels 30 when the drain structure panels 30 are secured to one another. FIG. 9 shows the sockets 60*a* and 60*b* having a rectangular configuration which allows the pins 62 to slide along the length of the sockets 60*a* and 60*b*, even after the pins 62 have been snapped or locked into the sockets 60*a* and 60*b*. By way of example, the pin 62 pay have a thickness of approximately 0.25 inches while the socket 60*a* and 60*b* may have a length of approximately 0.3750 to 1.0000 inches. While the sockets 60*a* and 60*b* have been illustrated has having a rectangular configuration, it will be appreciated that the sockets may be formed to have other configurations which would result in a secure attachment while permitting relative movement.

The high volume capacity and fluid transmissivity of the drain structure 14 provides a reliable means for circulating heated or other treated fluids throughout the subsurface. Heated air, for example, can be pumped into one edge of the drain structure 14 and withdrawn from another edge, allowing the heat to rise to, for example, an overlying football field in cold climates. Coupled with the use of an insulated field blanket, this feature of the drain structure 14 can extend the turf growing season for the field, and improve field conditions during snow storms. Alternatively or additionally, small diameter pipe networks may be installed in the drain structure 14 between the support structures 34 of the drain structure panels 30 to provide subsurface heating or cooling.

The installation of the drainage system 10 is briefly described again with reference to FIG. 1. The subbase 12 is graded according to methods and designs known in the art to define one or more surfaces sloping down to points or lines of fluid collection, that is, points toward which fluids flow upon the subbase's sloping surfaces. The subbase 12 preferably is packed to about 95% modified proctor density. The impermeable liner 13, or, alternatively, a semipermeable geotextile layer, such as a polyester spunbond non-woven fabric, is placed directly upon the subbase 12 to conform to its profile. The perforated collector pipe 24 is installed in a trench cut into the subbase 12, generally along each collection point at the bottom of each sloping surface of the subbase 12. Multiple collector pipes 24 are interconnected, as needed, to define a collector pipe network through which water will flow by gravity. The trench containing the collector pipe 24 is then backfilled with small gravel to the grade of the subbase 12.

After the installation of the collector pipe 24, optional, but desirable, systems are placed. Examples include an irrigation distribution system and risers, and/or heat distribution manifolds for connection to the drain structure 14 or to a pipe network to be placed within the drain structure 14. Also, foundations for such surface structures such as goal posts, bleachers, stages, and the like are placed.

Generally, the backing grid 32 of the drain structure panels 30 is placed face up, towards the ground surface and away from the subbase 12, to provide a smooth profile upon which to lay the semi-permeable filter fabric layer 16, and the openings 49 of the support members 34 are placed adjacent the impermeable liner 13 to foster fluid escape from the support members 34. The flexibility of the backing grid 32 permits the drain structure 14 to bend and flex to adapt to the overall contour and profile of the underlying subbase 12, yet the rigidity of the support members 34 maintains the uniform thickness of the drain structure 14.

The semi-permeable filter fabric layer 16, such as a polyester spunbond non-woven fabric, is next placed upon the drain structure 14 using shingle-overlapped joints. The widest roll of fabric preferably is used to minimize joints, and all joints may be secured with a suitable tape or similar fastener to prevent small particle intrusion through the semi-permeable filter fabric layer and into the drain structure 14.

The root zone layer 18 is then placed upon the filter fabric layer 16. It will be appreciated that the root zone layer 18 may vary in depth and composition. However, by way of example, the root zone soil layer 18 may be placed to a depth of from about eight inches to about eighteen inches. Furthermore, the root zone layer 18 will typically include a mixture of sand, organic matter, and inorganic matter in a ratio that will allow a water infiltration rate of about four inches to six inches per hour. The root zone layer 18 is topped with the turf layer 20 or other landscaping media.

The drain structure 14 has been described above for use in facilitating the drainage of water from a playing field, such as a football field or a golf putting green. It should be appreciated, however, that the drain structure 14 described herein may also be used to stabilize particulate materials, such as soil, sand, gravel, and asphalt, used in the construction of a variety of surfaces, such as grass covered driveways roads and parking lots and gravel covered parking lots, driveways, and trails. The drain structure 14 helps prevent erosion and supports the weight of vehicular and pedestrian traffic. When used to stabilize particulate materials, the drain structure 14 is typically installed grid side down directly onto a subbase or base layer. A selected particulate material is then spread over the drain structure 14 so that the particulate material fills the support members of the drain structure 14. The particulate material is then compacted or sod or seed is spread over the drain structure 14.

From the above description, it is clear that the present invention is well adapted to carry out the objects and to attain the advantages mentioned herein, as well as those inherent in the invention. While a presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A drain structure panel for a subsurface drainage assembly, comprising:

a plurality of spaced apart tubular support members arranged to define a unit having a plurality of side edges, the tubular support members having a first end, a second end, and a sidewall extending therebetween, each of the tubular support members being cloverleaf shaped;

at least one strut extending from each support member to another support member to laterally support the tubular support members; and a plurality of complimentary sets of male and female fasteners extending from the side edges to permit the male fasteners to be connected to the female fasteners of an adjacent drain structure panel.

2. The drain structure panel of claim 1 wherein the sidewall of each of the tubular support members is tapered from the first end toward the second end to permit the support members of one drain structure panel to be nested with the support members of another drain structure panel.

3. The drain structure panel of claim 1 wherein each of the tubular support members has at least one lower opening formed through the sidewall so as to intersect the second end of the tubular support member and at least one upper opening formed through the sidewall so as to intersect the first end of the tubular support member whereby fluid may flow from the tubular support members via the lower opening when the second end of the support members is engaged with a surface and when the first end of the support members is engaged with the surface, each of the upper and lower openings defining two corners with the upper and second ends of the tubular support member, respectively, each of the corners is rounded to provide a smooth, non-jagged transition from the first end and the second end of the support member to the opening.

4. A subsurface drainage assembly for directing fluid drainage from a surface, comprising:

a subbase beneath the surface; and a plurality of drain structure panels linked together and overlying the subbase, each drain structure panel comprising:

a plurality of spaced apart tubular support members arranged to define a unit having a plurality of side edges, the tubular support members having a first end, a second end, and a sidewall extending therebetween, each of the tubular support members being cloverleaf shaped;

at least one strut extending from each support member to another support member to laterally support the tubular support members; and a plurality of complimentary sets of male and female fasteners extending from the side edges so that the male fasteners are connected to the female fasteners of an adjacent drain structure panel.

5. The subsurface drainage assembly of claim 4 wherein the sidewall of each of the tubular support members is tapered from the first end to the second end to permit the support members of one drain structure panel to be nested with the support members of another drain structure panel.

6. The subsurface drainage assembly of claim 4 wherein each of the tubular support members has at least one lower opening formed through the sidewall so as to intersect the second end of the tubular support member and at least one upper opening formed through the sidewall so as to intersect the first end of the tubular support member whereby fluid may flow from the tubular support members via the lower opening when the second end of the support members is engaged with a surface and when the first end of the support members is engaged with the surface, each of the upper and lower openings defining two corners with the upper and second ends of the tubular support member, respectively, each of the corners is rounded to provide a smooth, non-jagged transition from the first end and the second end of the support member to the opening.

7. A package of drain structure panels for a subsurface drainage assembly, comprising:

a first drain structure panel, the first drain structure panel comprising:

a plurality of spaced apart tubular support members arranged to define a unit having a plurality of side edges, the tubular support members having a first end, a second end, and a sidewall extending therebetween; and at least one strut extending from the first end of each support member to another support member to laterally support the tubular support members; and a second drain structure panel linkable to the side edge of the first drain structure panel in a coplanar relationship, the second drain structure panel comprising:

a plurality of spaced apart tubular support members arranged to define a unit having a plurality of side edges, the tubular support members having a first end, a second end, and a sidewall extending therebetween; and at least one strut extending from the first end of each support member to another support member to laterally support the tubular support members, wherein each of the tubular support members is cloverleaf shaped, and wherein the second end of the first drain structure panel is inserted in the first end of the second drain structure panel so that the tubular support members of the first drain structure panel is nested with the tubular support members of the second drain structure panel to facilitate transport of the first and second drain structure panels.

8. The package of claim 7 wherein the sidewall of each of the tubular support members of the first and second drain structure panels is tapered from the first end to the second end.

9. A drain structure panel for a subsurface drainage assembly, comprising:

a plurality of spaced apart tubular support members arranged to define a unit having a plurality of side edges, the tubular support members having a first end, a second end, and a sidewall extending therebetween, each of the tubular support members being cloverleaf shaped; and at least one strut extending from the first end of each support member to another support member to laterally support the tubular support members, wherein the sidewall of each of the tubular support members is tapered from the first end to the second end so that the tubular support members are nestable with the tubular support members of an identical drain structure panel.

10. A subsurface drainage assembly for directing fluid drainage from a surface, comprising:

a subbase beneath the surface; and a plurality of drain structure panels linked together and overlying the subbase, each drain structure panel comprising:

a plurality of tubular support members interconnected to define a unit having a plurality of side edges, the tubular support members having a first end, a second end, and a sidewall extending therebetween, each of the tubular support members being cloverleaf shaped; and a plurality of complimentary sets of male and female fasteners extending from the side edges to permit the male fasteners to be connected to the female fasteners of an adjacent drain structure panel, wherein the sidewall of each of the tubular support members is tapered from the first end to the second end so that the tubular support members are nestable with the tubular support members of an identical drain structure panel.

* * * * *